US008374530B2

(12) United States Patent
Hirahara et al.

(10) Patent No.: US 8,374,530 B2
(45) Date of Patent: Feb. 12, 2013

(54) METHODS AND APPARATUS FOR DEVELOPING AN ELECTROSTATIC LATENT IMAGE USING CONDUCTIVE PARTICLES

(75) Inventors: Hideaki Hirahara, Kanagawa (JP); Takaaki Konuma, Kyoto (JP); Norio Yamagishi, Tokyo (JP)

(73) Assignee: Afit Corporation, Tokyo (JP)

( * ) Notice: Subject to any disclaimer, the term of this patent is extended or adjusted under 35 U.S.C. 154(b) by 587 days.

(21) Appl. No.: 11/425,198

(22) Filed: Jun. 20, 2006

(65) Prior Publication Data

US 2007/0031169 A1 Feb. 8, 2007

(30) Foreign Application Priority Data

Jul. 25, 2005 (JP) ..... 2005-214192

(51) Int. Cl.
*G03G 15/08* (2006.01)

(52) U.S. Cl. ..... 399/265; 430/122.1; 430/122.6; 399/252

(58) Field of Classification Search ..... 430/122.1, 430/122.6; 399/252, 265
See application file for complete search history.

(56) References Cited

U.S. PATENT DOCUMENTS

| | | | | |
|---|---|---|---|---|
| 3,563,734 | A | 2/1971 | Shely | |
| 4,430,409 | A * | 2/1984 | Matsumoto et al. | 430/108.7 |
| 4,508,052 | A * | 4/1985 | Kohyama | 399/282 |
| 4,661,430 | A * | 4/1987 | Wakamiya et al. | 430/122.8 |
| 5,158,852 | A * | 10/1992 | Sakata et al. | 430/122.4 |
| 5,416,569 | A * | 5/1995 | Goldberg | 399/318 |
| 6,391,511 | B1 * | 5/2002 | Okamoto et al. | 430/123.3 |
| 2003/0077532 | A1 * | 4/2003 | Okada et al. | 430/108.1 |
| 2003/0157419 | A1 * | 8/2003 | Miyakawa et al. | 430/108.6 |
| 2003/0224279 | A1 * | 12/2003 | Kotsugai et al. | 430/111.1 |
| 2003/0228177 | A1 * | 12/2003 | Hirsch | 399/265 |
| 2003/0232185 | A1 * | 12/2003 | Shimamura et al. | 428/323 |
| 2004/0043315 | A1 * | 3/2004 | Takiguchi et al. | 430/108.6 |
| 2004/0228661 | A1 * | 11/2004 | Fujishima et al. | 399/279 |
| 2004/0234877 | A1 * | 11/2004 | Yoshino et al. | 430/108.1 |
| 2006/0063093 | A1 * | 3/2006 | Kurosu | 430/122 |

FOREIGN PATENT DOCUMENTS

| | | |
|---|---|---|
| JP | 55-018656 A | 7/1978 |
| JP | 55-018657 A | 7/1978 |
| JP | 55-018658 A | 7/1978 |
| JP | 55-018659 A | 7/1978 |
| JP | S58-57783 | 6/1983 |
| JP | S59-189617 | 10/1984 |
| JP | S59-202682 | 11/1984 |
| JP | S60-137886 | 7/1985 |
| JP | S59-160690 | 8/1985 |
| JP | 07-254768 | 10/1995 |
| JP | 2000-221780 | 8/2000 |

OTHER PUBLICATIONS

Takahashi et al., "Mechanism of Canon Toner Projection Development," vol. 26, No. 5, Sep./Oct. 1982, Photographic Science and Engineering.

* cited by examiner

*Primary Examiner* — Mark F Huff
*Assistant Examiner* — Rachel Zhang
(74) *Attorney, Agent, or Firm* — Duft Bornsen & Fettig LLP

(57) ABSTRACT

Methods and apparatus to develop an electrostatic latent image using conductive particles, such as carbon and metal particles with a low resistance value, without treating the surface with insulation membrane or other insulators that generate impurities in the conductive material printed by the imaging system.

12 Claims, 2 Drawing Sheets

METHODS AND APPARATUS FOR DEVELOPING AN ELECTROSTATIC LATENT IMAGE USING CONDUCTIVE PARTICLES

BACKGROUND

1. Field of the Invention

The invention relates to development of latent images in an electrostatic printing process and electrophotographic process and, in particular, relates to a development process using conductive particles.

2. Discussion of Related Art

Electrophotography was invented in 1938 by Chester Floyd Carlson and spread throughout the world because of the superior resolution and output speed. The field of electrophotography has been constantly improving and improvements continue today. One example of electrophotography is electrostatic printing. The material used in developing an electrostatic latent image is referred to as toner and various improvements to toner have been a large factor in the world-wide growth of copying machines and printers.

In general, toner is a mixture of pigment and resin particles. Commonly, an electrostatic latent image is developed using an electrostatic charge with a carrier or development sleeve (in a dry system) or solvation (in a liquid system). The toner holds an electrostatic charge and is transported to the vicinity of the electrostatic image holding body where the latent image is developed when the toner is attached to the image holding body by an electric field. For a system requiring transfer of the latent image (i.e., copiers and printers), the toner maintains an electrostatic charge on the image holding body and it is transported onto the transfer media by an electric field of opposite polarity to the toner charge at a transfer station.

In order for the electrophotographic process to function as presently practiced the toner's surface must be an insulating material that holds an electrostatic charge. In recent years, various improvements have been made that have led to the development of conductive toners that meet the requirements of manufacturing a printed circuit board directly from digital data taking advantage of the high resolution and fast output speed characteristic of electrostatic printing.

Existing systems and methods are utilizing metal (e.g., conductive) toner by covering the conductive particles with an insulating resin. These prior systems and methods aim for a development process in electrophotography using metal particles covered with a thin insulation membrane so that the insulated metal particles behave similar to an insulated toner with respect to electrostatic imaging processes. In these existing electrostatic printing and electrophotographic processes, electrically conductive toner and metal toner are covered with an insulation layer as discussed above—they are not simply conductive particles and metals.

It is well-known and relatively easy to make an insulating membrane layer on conductive material for use with presently known electrostatic printing or electrophotographic process, but it is very difficult to use conductive material made without such an insulating membrane in presently known electrophotographic printing processes. The purpose of the conductive material in printed traces of a printed circuit board is to apply an electrical current through the conductive material, but insulating the conductive material with a membrane makes the resulting printed traces high in resistance, be it an electrode or wiring. Present methods require removing the insulation membrane layer with high temperature to purify the conductive material imprinted as electrical traces. For that reason, use of electrophotography for producing printed circuit board is currently only in limited applications.

In order to improve the conductivity, another approach as shown in Japanese patent disclosures No. 1983-57783 and No. 1995-254768 includes vanadium on the surface of regular toner. Vanadium is the base material used in well known metal plating processes. After patterning and fixing the vanadium image traces on a circuit board, a metal plating process is done to form a conductive pattern. However, the merit of manufacturing a printed circuit board directly from digital data is diminished by adding the extra process. Also, industry requirements that no impurities be added to the conductive material of a printed circuit board are becoming more critical. It is more important that the conductive material of a printed circuit board be pure and highly conductive.

At present, a pure conductive material (e.g., un-insulated metal) cannot be used by electrophotographic and electrostatic printing processes without pre-treatment because all the required characteristics for electrostatic toner are contrary to the characteristics of a conductive material. The toner requirements are in general as follows:

- it must be dispersed as single particles;
- it needs to be transported to the vicinity of an image holding body;
- it cannot scatter while transported;
- it must not destroy the electrostatic latent image;
- it has to be charged with the correct electrostatic polarity characteristics; and
- it must not attach to any parts other then the targeted latent image.

Regular (e.g., non-conductive) toner is almost an insulator and the each particle repels from each other when it is charged with static electricity. Also, toner attaches to other materials, called carrier, through charging and does not scatter, even when transported mechanically. Even more particularly, toner will not destroy a latent image it touches since toner is an insulator and toner will only attach to the location where it is electrostatically attracted and will not attach where repelled. Standard, known, non-conductive toner is made so that each particle is evenly well charged and made with a certain intended polarity.

However, it is difficult to disperse and charge individual particles of conductive material and difficult to maintain the electrostatic charge. Because of the conductive properties of the charged particles, they would scatter when transported and destroy any latent image they may come in contact with.

It is therefore evident from the above discussion that a need exists for improved apparatus and methods for developing an electrostatic latent image using conductive particles.

SUMMARY

As stated previously, the success of conductive material as a developer (toner) depends on how well the conductive material can be charged, transported, dispersed, and prevented from destroying the latent image. The present invention provides a method and apparatus for development in an electrophotographic imaging system using conductive particles without special treatment to the carbon or metal conductive particles.

DETAILED DESCRIPTION OF THE DRAWINGS

Figure 1:
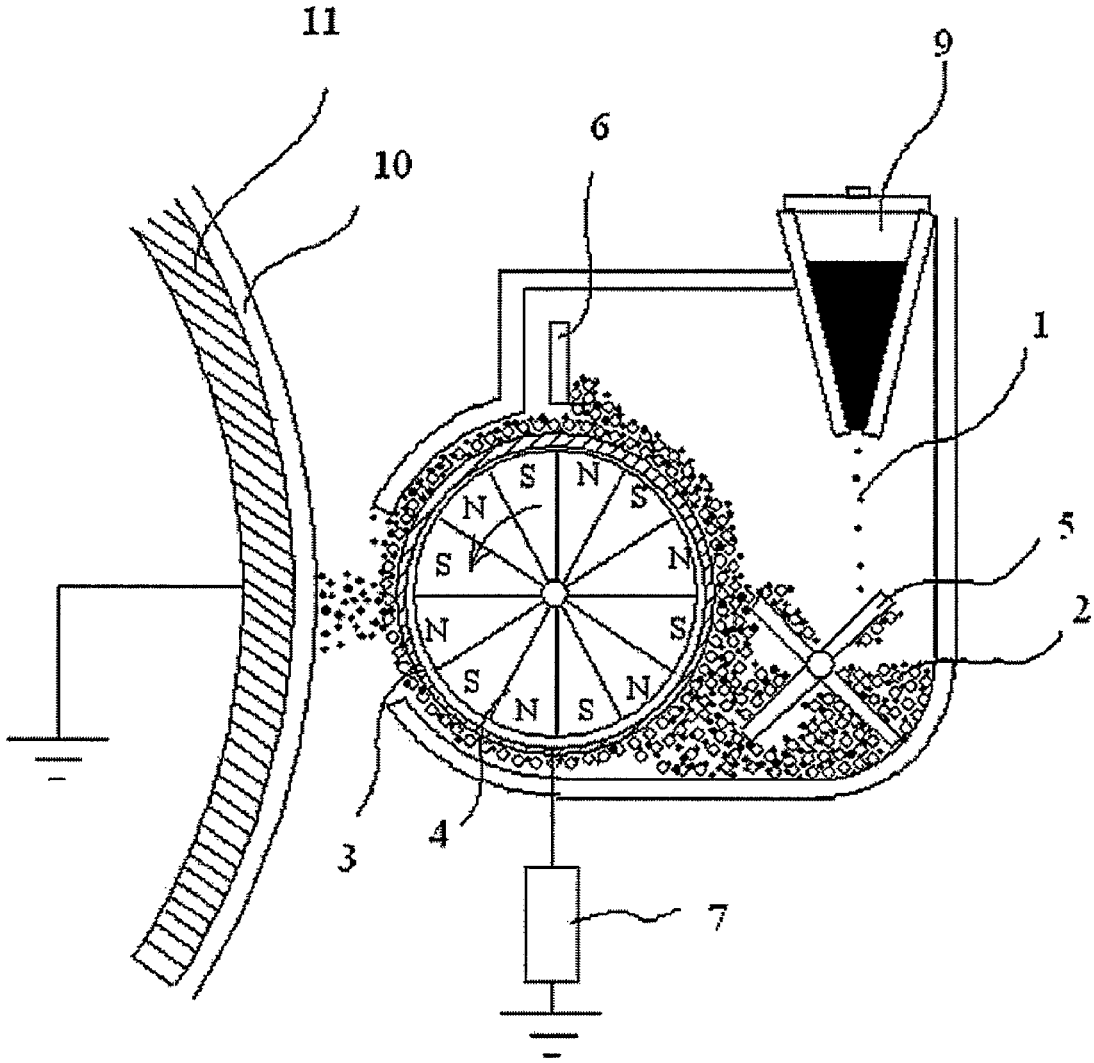
FIG. 1 is an explanatory drawing of a basic method for a low speed implementation in accordance with features and aspects hereof.
Figure 2:
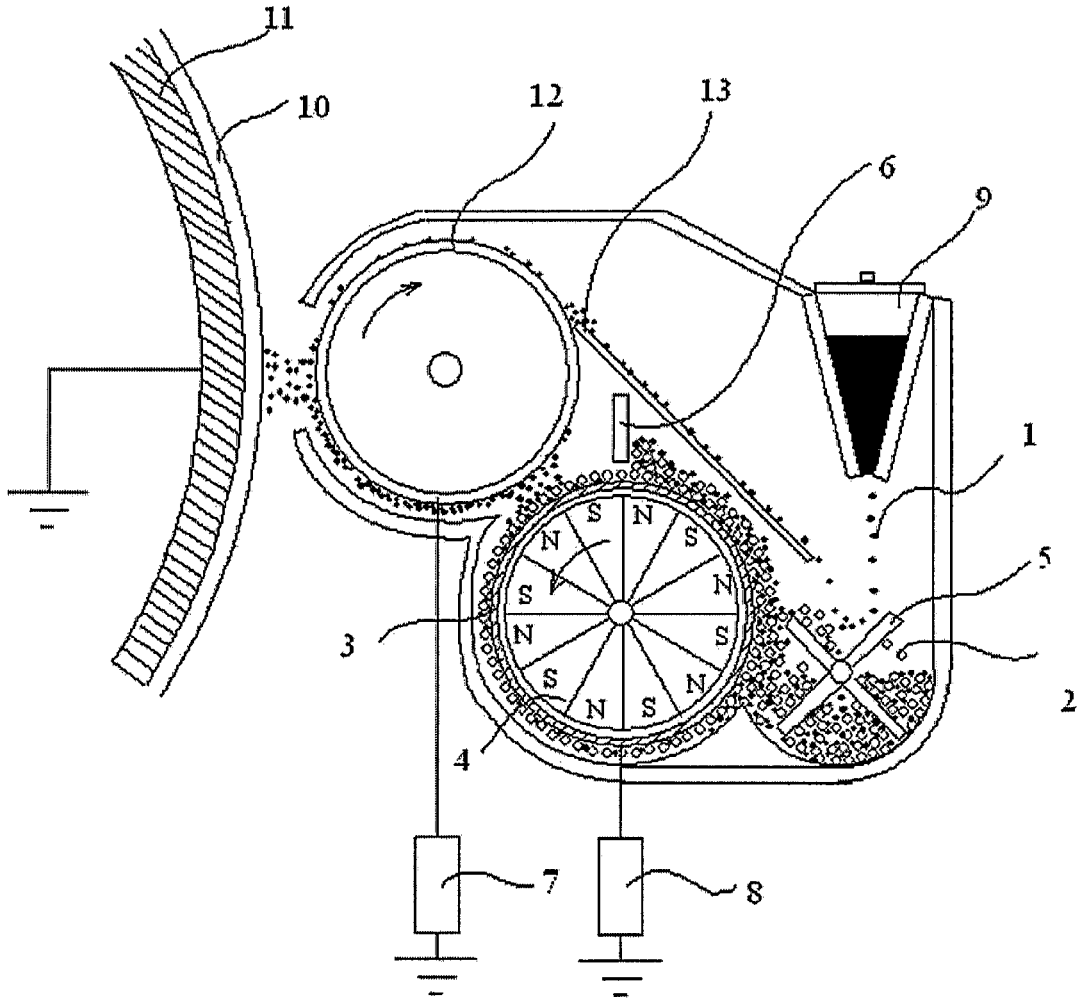
FIG. 2 is an explanatory drawing of the basic method for a higher speed implementation in accordance with features and aspects hereof.

FIGS. 1 and 2 and the following description are intended merely as representative of exemplary embodiments of the invention to teach those skilled in the art how to make and use the invention. For the purpose of teaching inventive principles, some conventional aspects of the invention have been simplified or omitted. Those skilled in the art will appreciate variations from these embodiments that fall within the scope of the invention. Those skilled in the art will appreciate that the features described below may be combined in various ways to form multiple variations of the invention. As a result, the invention is not limited to the specific embodiments described below, but only by the claims and their equivalents.

FIG. 1 is a drawing of an exemplary basic structure for a low speed implementation of features and aspects hereof. The conductive particles 1 and the carrier 2 are mixed and dispersed by rotating paddle 5. A magnetic roller comprises a non-magnetic conductive sleeve 3 and magnetic assembly 4. The assembly 4 and sleeve 3 are rotatable independently. The carrier 2 holds the conductive particles 1 and becomes attracted to sleeve 3 by the magnetic assembly 4.

As the sleeve 3 rotates, the thickness of the mixture of carrier 2 and conductive particle 1 is regulated by the control blade 6. The image holding body is made of conductive substrate 11 and insulation membrane or photoconductor 10 and the latent image is formed electrostatically by well known digital data imaging structures (not shown) such as a laser or LED array. For simplicity of this discussion, the photoconductor surface 10 of the image holding body may also be generally and synonymously referred to as the "image holding body" since it is the photoconductor surface 10 that performs the function of the image holding body relevant to this discussion.

When voltage is supplied from the development bias power supply 7 to sleeve 3, conductive particle 1 receives an electrical charge from sleeve 3 or carrier 2. The conductive particles 1 leap to the photoconductor 10 of the image holding body and thereby develop the electrostatic latent image. The supply of conductive particles is then replenished in the mixing section of the developer from the toner hopper 9 as needed and mixed with carrier 2 by the rotating paddle 5. A magnetic carrier material, such as ferrite or iron particles, can be used for non-magnetic conductive particles such as carbon, copper, and aluminum. A non-magnetic carrier material, such as glass particles, resin particles or ceramic particles, can be used for magnetic conductive particles such as iron and nickel.

Since a conductive particle 1 leaps to the image holding body 10 by obtaining charge from sleeve 3 or carrier 2, it is desirable that the carrier 2 is electrically conductive to leap efficiently. FIG. 1 shows an example using a magnetic carrier. The structure of FIG. 1 is similar to an ordinary magnetic roller development unit, but the function of each part is different. The conductive particles 1 are not charged by being mixed with the carrier, the effect is rather dispersed into micro-particles.

Also, the conductive particles are attracted to sleeve 3 and transported by the magnetic assembly 4, not by charged carrier attraction. When carrier 2 is magnetic, the conductive particles are mechanically held between the carrier 2 particles. When carrier 2 is non-magnetic, the conductive particles themselves are magnetic, attracted to sleeve 3, and transported by the magnetic assembly 4.

The conductive particles 1 leap to the photoconductor 10 by an electric field created by the voltage difference between the development bias power supply 7 and the charged latent image on the photoconductor 10 without touching the image holding body at the point closest to the photoconductor 10. When the conductive particle 1 receives electric charge from the sleeve 3 or carrier 2 it leaps to the image holding body where the latent image is appropriately charged (on the photoconductor surface 10). Since there is no physical contact between the sleeve 3 or carrier 2 and the photoconductor surface 10, the latent image will not be destroyed.

The voltage of the development bias power supply 7 is selected according to the electric field required to leap the particle materials to the latent image. The electric field is also adjusted, as well known by those of ordinary skill in the art, to avoid generating undesirable background images. The proper development bias voltage differs according to the voltage of latent image (signal voltage), background (of the un-imaged portions of the photoconductor), the gap distance between the conductive non-magnetic sleeve 3 and the photoconductor surface 10, and the mass or size of a typical conductive particle 1. In accordance with features and aspects hereof, it becomes possible to develop a high resolution and high contrast electrostatic latent image onto an image holding body using non-treated, low resistance conductive particles. Since carbon or metal particles with a resistance of less than $10^2$ Ω-cm are conductive, the particles gather the electric charge from an electrode (sleeve 3) or carrier with high electric field resulting being charged and forced to leap. Where the electric field is low due to the latent image voltage, it is not possible for the conductive particle to gather or release the electrical charge and unable to leap across the gap. As a result, there is virtually no adhesion of conductive particles on the background (un-imaged areas of he photoconductor) and it is possible to obtain a high contrast development.

By way of example, a developed image was obtained in the following conditions:

- The image holding body 10 was charged to +700V as the background (non-imaged areas) and discharged to a signal voltage of +100V (where the latent image is present).
- Metallic copper particles of average particle diameter 7μ and about 3 mm spacing.
- The development bias voltage was +800V. The metal copper particles did not leap at the electric field of 100V level, but they leaped with the charge of +700V level electric field and they were being charged positive.

Further by way of example, useful images are formed in the following conditions:

- The image holding body background charge 0V (non-imaged areas) and charged to a signal voltage of +600V (imaged areas).
- Metallic copper particles of average particle diameter 7μ and about 3 mm spacing.
- A similar electric field voltage difference to the previous case by applying the development bias voltage of about −200V.
- The metal copper particles are charged negatively in this case and leaped.

The metallic copper particle shows 1.0 Ω-cm which may include the contact resistance between particles. The charging polarity of conductive particles can be controlled freely by the polarity of supplying development bias voltage. Additionally, the voltage of development bias power supply 7 can be DC (direct current) only, but the leaping efficiency improves if an AC (alternating current) component is superpositioned. In one exemplary embodiment, the AC current may have a frequency of about 500 Hz to 10 KHz. The conductive particle 1 obtains the charge from the carrier 2 or sleeve 3 by electric field, or releases the electric charge of opposite polarity on the contacting surfaces of sleeve 3 and electrified. As a result, the metallic copper particle leaps over the space and adheres to only the latent image part.

The conductive particles 1 which are located in the back of carrier 2 on the sleeve 3 (e.g., closer to the surface of sleeve 3) may have difficulty in leaping through the carrier layer on the sleeve 3 and hence the development efficiency relating to those particles tends to be low. The development efficiency can be improved where, for example, the iron particles of carrier 2 roll on the sleeve 3 and conductive particles 1 are moved up toward the surface (outward from the surface of sleeve 3) for easier leaping by rotating the magnetic roller in the magnetic assembly 4 in opposite direction of the sleeve 3. Also, it is desirable for the carrier material 2 which is mixed with the conductive particles 1 not to be electrified. Therefore pre-treatment of the surface for conductivity will help stabilize the development situation.

When the process speed of the system is fast, the rotational speed of the sleeve 3 is required to be higher in order to supply a larger volume of developer material (carrier 2 with suspended particles 1). If the sleeve 3 rotates too fast, however, the conductive particles may scatter due to the centrifugal force before they can be charged with the electric field, resulting in a blemish due to the non-charging particles adhesion on the non-imaged portion. Therefore, there is a limit on rotational speed on sleeve 3 and also the amount of conductive particles 1 to be transferred. FIG. 1 is therefore an exemplary structure suitable for the lower speed system applications (e.g., process speeds at or under about 100 mm/sec as measured at the sleeve surface velocity).

FIG. 2 shows another exemplary embodiment of features and aspects hereof suitable for a higher speed implementation of the invention. The development roller 12 and scraper 13 are added between the image holding body and the conductive non-magnetic sleeve 3 of the magnetic roller. The development roller 12 and sleeve 3 are configured so that the parts are not in contact with each other. Development bias power supply 7 is connected to the development roller 12 and conductive non-magnetic sleeve 3 in the magnetic roller is connected to the auxiliary power supply 8.

The development bias power supply 7 is determined similar to the explanation of FIG. 1 based on the polarity and voltage of the latent image on image holding body 10. The electric field for the conductive particles 1 to leap is given between the auxiliary power supply 8 and development bias power supply 7. The electric field between the development roller 12 and the photoconductor 10 causes charged conductive toner particles presently held to the development roller 12 to transfer to the photoconductor 10 in accordance with the charge associated with the latent image. The auxiliary power supply 8 in conjunction with supply 7 determines the magnitude of an electric field between sleeve 3 and development roller 12 for the conductive particles to be able to transfer therebetween. For example, in order for the conductive carbon particle with an average particle diameter of 7μ and a resistance value of $10^2$ Ω-cm to leap a gap of about 3 mm to the image holding body 10 with background charge of +700V and a signal voltage +100V, the development bias voltage of +800V or +1500V from the auxiliary power supply 8 were applied.

The conductive carbon particles leaped from the sleeve 3 to the surface of development roller 12 and then leaped from the development roller 12 to the appropriately charged portions of the latent image on the image holding body 10 generate an image with sufficient contrast development. The benefit of the method shown in FIG. 2 is the ability of the sleeve 3 to increase the rotational speed. In the event the conductive particles adhere on the development roller 12 without electrification because of increased sleeve 3 rotational speed and are scattered due to centrifugal force, the conductive particles are charged by the supply voltage from the development bias power supply 7 when they leap from the development roller 12 to the image holding body 10.

By this process, a higher volume of conductive particles can be assured in a high speed process even for the materials which are prone to scatter, such as conductive carbon, and it is possible to obtain the development with sufficient contrast. The various conditions such as applied voltages and gaps in the aforementioned examples are exemplary, typical, and suitable conditions and will differ based on conductive particles material, particle size, and specific gravity. Thus these exemplary conditions are not intended to limit the scope hereof but rather merely intended to exemplify some useful conditions.

While the invention has been illustrated and described in the drawings and foregoing description, such illustration and description is to be considered as exemplary and not restrictive in character. One embodiment of the invention and minor variants thereof have been shown and described. Protection is desired for all changes and modifications that come within the spirit of the invention. Those skilled in the art will appreciate variations of the above-described embodiments that fall within the scope of the invention. In particular, those of ordinary skill in the art will readily recognize that features and aspects hereof may be implemented with other equivalent methods and apparatus. As a result, the invention is not limited to the specific examples and illustrations discussed above, but only by the following claims and their equivalents.

What is claimed is:

1. A method for developing an electrostatic latent image on an image holding body the developed latent image comprising conductive toner particles to be transferred to a transfer medium, the method comprising:

providing a developer assembly including a mixture of conductive toner particles and carrier particles wherein the conductive toner particles are devoid of an insulative layer, wherein the conductive particles consist essentially of particles selected from the group consisting of carbon and metal, and wherein the conductive particles have a resistance value of less than about $10^2$ Ω-cm, wherein the mixture including the conductive toner particles in the developer assembly is positioned at a non-contact proximate position to the image holding body, wherein the mixture of carrier particles and conductive toner particles comprises both magnetic and non-magnetic materials, wherein the developer assembly further comprises:

a magnetic assembly;

a conductive non-magnetic rotating sleeve encapsulating the magnetic assembly, wherein the developer assembly is positioned such that the image holding body and the conductive non-magnetic rotating sleeve are at a non-contact proximate position with respect to one another;

mixing the conductive toner particles with carrier particles such that the magnetic assembly attracts the mixture to the conductive non-magnetic rotating sleeve;

charging the conductive toner particles in the mixture attracted to the conductive non-magnetic rotating sleeve by applying a voltage to the conductive non-magnetic rotating sleeve; and generating a first electric field and a second electric field associated with the developer assembly, the electric fields adapted to cause the conductive toner particles to leap from the developer assembly to the image holding body by the generated electric fields, wherein the conductive toner particles comprise non-magnetic conductive particles, wherein the carrier particles comprise magnetic carrier particles selected from the group consisting of ferrite and iron, whereby the conductive toner particles are held by mechanical forces of the magnetic carrier particles, wherein the developer assembly further comprises a development roller, wherein the development roller is at a non-contact proximate position with respect to the magnetic assembly and with respect to the conductive non-magnetic rotating sleeve and with respect to the image holding body, wherein the generated first electric field is adapted to cause the conductive particles to leap from the conductive non-magnetic rotating sleeve to the development roller, and wherein the generated second electric field is further adapted to next cause the conductive particles to leap from the development roller to the image holding body.

2. The method of claim 1 wherein surface of the carrier particles is pre-treated for conductivity.

3. The method of claim 1 wherein the generated electric field is adapted to generate superpositioned direct current voltage and alternating current voltage with frequencies of 500 Hz to 10 KHz.

4. A method for developing an electrostatic latent image on an image holding body the developed latent image comprising conductive toner particles to be transferred to a transfer medium, the method comprising:

providing a developer assembly including a mixture of conductive toner particles and carrier particles wherein the conductive toner particles are devoid of an insulative layer, wherein the conductive particles consist essentially of particles selected from the group consisting of carbon and metal, and wherein the conductive particles have a resistance value of less than about $10^2$ Ω-cm, wherein the mixture including the conductive toner particles in the developer assembly is positioned at a non-contact proximate position to the image holding body, wherein the mixture of carrier particles and conductive toner particles comprises both magnetic and non-magnetic materials, wherein the developer assembly further comprises:

a magnetic assembly;

a conductive non-magnetic rotating sleeve encapsulating the magnetic assembly, wherein the developer assembly is positioned such that the image holding body and the conductive non-magnetic rotating sleeve are at a non-contact proximate position with respect to one another;

mixing the conductive toner particles with carrier particles such that the magnetic assembly attracts the mixture to the conductive non-magnetic rotating sleeve;

charging the conductive toner particles in the mixture attracted to the conductive non-magnetic rotating sleeve by applying a voltage to the conductive non-magnetic rotating sleeve; and generating a first electric field and a second electric field associated with the developer assembly, the electric fields adapted to cause the conductive toner particles to leap from the developer assembly to the image holding body by the generated electric fields, wherein the conductive toner particles comprise magnetic conductive particles, whereby the conductive toner particles are held by magnetic forces of the magnetic assembly, wherein the carrier particles comprise non-magnetic carrier particles selected from the group consisting of glass, resin, and ceramic, wherein the developer assembly further comprises a development roller, wherein the development roller is at a non-contact proximate position with respect to the magnetic assembly and with respect to the conductive non-magnetic rotating sleeve and with respect to the image holding body, wherein the generated first electric field is adapted to first cause the conductive particles to leap from the conductive non-magnetic rotating sleeve to the development roller, and wherein the generated second electric field is further adapted to next cause the particles to leap from the development roller to the image holding body.

5. The method of claim 4 wherein surface of the carrier particles is pre-treated for conductivity.

6. The method of claim 4 wherein the generated electric field is adapted to generate superpositioned direct current voltage and alternating current voltage with frequencies of 500 Hz to 10 KHz.

7. Apparatus for developing an electrostatic latent image on an image holding body, the apparatus comprising:

a developer assembly including a mixture of conductive toner particles and carrier particles, wherein the conductive toner particles are devoid of an insulative layer, wherein the conductive particles consist essentially of particles selected from the group consisting of carbon and metal, and wherein the conductive particles have a resistance value of less than about $10^2$ Ω-cm, wherein the mixture including the conductive toner particles in the developer assembly is positioned at a non-contact proximate position to the image holding body, wherein the mixture of carrier particles and conductive toner particles comprises both magnetic and non-magnetic materials, wherein the developer assembly further comprises:

a magnetic assembly;

a conductive non-magnetic rotating sleeve encapsulating the magnetic assembly, wherein the developer assembly is positioned such that the image holding body and the conductive non-magnetic rotating sleeve are at a non-contact proximate position with respect to one another;

wherein the developer assembly is adapted to mix the conductive toner particles with carrier particles such that the magnetic assembly attracts the mixture to the conductive non-magnetic rotating sleeve;

wherein the developer assembly is adapted to charge the conductive toner particles in the mixture attracted to the conductive non-magnetic rotating sleeve by applying a voltage to the conductive non-magnetic rotating sleeve; and an electric generator associated with the developer assembly wherein the electric field generator is adapted to generate a first electric field and a second electric field to cause the conductive toner particles to leap from the developer assembly to the image holding body by the generated electric fields, wherein the conductive toner particles comprise non-magnetic conductive particles, wherein the carrier particles are magnetic carrier particles selected from the group consisting of ferrite and iron, whereby the conductive toner particles are held by mechanical forces of the magnetic carrier particles, wherein the developer assembly further comprises a development roller, wherein the development roller is at a non-contact proximate position with respect to the magnetic assembly and with respect to the conductive non-magnetic rotating sleeve and with respect to the image holding body, wherein the first electric field causes the conductive particles to leap from the conductive non-magnetic rotating sleeve to the development roller by electric field, and wherein the second electric field causes the conductive particles to leap from the from the development roller to the image holding body by electric field.

8. The apparatus of claim 7 wherein the surface of the carrier particles is pre-treated for conductivity.

9. The apparatus of claim 7 wherein the electric generator is adapted to generate superpositioned direct current voltage and alternating current voltage with frequencies of 500 Hz to 10 KHz.

10. Apparatus for developing an electrostatic latent image on an image holding body, the apparatus comprising:

a developer assembly including a mixture of conductive toner particles and carrier particles, wherein the conductive toner particles are devoid of an insulative layer, wherein the conductive particles consist essentially of particles selected from the group consisting of carbon and metal, and wherein the conductive particles have a resistance value of less than about $10^2$ Ω-cm, wherein the mixture including the conductive toner particles in the developer assembly is positioned at a non-contact proximate position to the image holding body, wherein the mixture of carrier particles and conductive toner particles comprises both magnetic and non-magnetic materials, wherein the developer assembly further comprises:

a magnetic assembly;

a conductive non-magnetic rotating sleeve encapsulating the magnetic assembly, wherein the developer assembly is positioned such that the image holding body and the conductive non-magnetic rotating sleeve are at a non-contact proximate position with respect to one another;

wherein the developer assembly is adapted to mix the conductive toner particles with carrier particles such that the magnetic assembly attracts the mixture to the conductive non-magnetic rotating sleeve;

wherein the developer assembly is adapted to charge the conductive toner particles in the mixture attracted to the conductive non-magnetic rotating sleeve by applying a voltage to the conductive non-magnetic rotating sleeve; and an electric generator associated with the developer assembly wherein the electric field generator is adapted to generate a first electric field and a second electric field to cause the conductive toner particles to leap from the developer assembly to the image holding body by the generated electric fields, wherein the conductive toner particles comprise magnetic conductive particles, whereby the conductive toner particles are held by magnetic forces of the magnetic assembly, wherein the carrier particles are non-magnetic carrier particles selected from the group consisting of glass, resin, and ceramic, wherein the developer assembly further comprises a development roller, wherein the development roller is at a non-contact proximate position with respect to the magnetic assembly and with respect to the conductive non-magnetic rotating sleeve and with respect to the image holding body, wherein the first electric field causes the conductive particles to leap from the conductive non-magnetic rotating sleeve to the development roller by electric field, and wherein the second electric field causes the conductive particles to leap from the development roller to the image holding body by electric field.

11. The apparatus of claim 10 wherein the surface of the carrier particles is pre-treated for conductivity.

12. The apparatus of claim 10 wherein the electric generator is adapted to generate superpositioned direct current voltage and alternating current voltage with frequencies of 500 Hz to 10 KHz.

* * * * *